US010047328B2

(12) United States Patent
Naqvi et al.

(10) Patent No.: US 10,047,328 B2
(45) Date of Patent: Aug. 14, 2018

(54) UNIT DOSE DETERGENT COMPOSITIONS

(71) Applicant: Henkel IP & Holding GmbH, Düsseldorf (DE)

(72) Inventors: Syed Humza Naqvi, Hamilton, NJ (US); Troy Robert Graham, Ansonia, CT (US); Ryan Bradley Cameron, Newtown, CT (US)

(73) Assignee: Hekel IP & Holding GmbH (DE)

( * ) Notice: Subject to any disclaimer, the term of this patent is extended or adjusted under 35 U.S.C. 154(b) by 15 days.

(21) Appl. No.: 14/693,614

(22) Filed: Apr. 22, 2015

(65) Prior Publication Data

US 2015/0329807 A1 Nov. 19, 2015

Related U.S. Application Data

(60) Provisional application No. 61/982,688, filed on Apr. 22, 2014.

(51) Int. Cl.

| | |
|---|---|
| ***C11D 1/29*** | (2006.01) |
| ***C11D 1/72*** | (2006.01) |
| ***C11D 17/08*** | (2006.01) |
| ***C11D 17/04*** | (2006.01) |
| ***C11D 3/20*** | (2006.01) |
| ***C11D 1/12*** | (2006.01) |
| ***C11D 1/66*** | (2006.01) |
| ***C11D 1/02*** | (2006.01) |
| ***C11D 1/88*** | (2006.01) |
| ***C11D 1/94*** | (2006.01) |

(52) U.S. Cl.

CPC ..... *C11D 17/043* (2013.01); *C11D 1/02* (2013.01); *C11D 1/12* (2013.01); *C11D 1/29* (2013.01); *C11D 1/66* (2013.01); *C11D 1/88* (2013.01); *C11D 1/94* (2013.01); *C11D 3/2003* (2013.01); *C11D 3/2041* (2013.01); *C11D 3/2044* (2013.01); *C11D 3/2065* (2013.01)

(58) Field of Classification Search

CPC .... C11D 1/02; C11D 1/29; C11D 1/66; C11D 1/88; C11D 1/94; C11D 3/2003; C11D 3/2044; C11D 3/2065; C11D 17/043

USPC ..... 510/296, 439, 505, 506

See application file for complete search history.

(56) References Cited

U.S. PATENT DOCUMENTS

| | | | | |
|---|---|---|---|---|
| 3,218,776 | A | 11/1965 | Cloud | |
| 3,453,779 | A | 7/1969 | Reifenberg | |
| 3,929,678 | A | 12/1975 | Laughlin et al. | |
| 3,976,586 | A | 8/1976 | Chakrabarti | |
| 4,663,071 | A | 5/1987 | Bush et al. | |
| 4,776,455 | A | 10/1988 | Anderson et al. | |
| 4,973,416 | A | 11/1990 | Kennedy | |
| 5,500,151 | A * | 3/1996 | Cao | C11D 1/94 510/321 |
| 5,616,781 | A | 4/1997 | Sajic et al. | |
| 5,699,653 | A | 12/1997 | Hartman et al. | |
| 5,722,217 | A | 3/1998 | Cloud | |
| 5,945,394 | A | 8/1999 | Sajic et al. | |
| 5,958,864 | A | 9/1999 | Gonzalez et al. | |
| 6,037,319 | A | 3/2000 | Dickler et al. | |
| 6,040,287 | A * | 3/2000 | Motyka | C11D 1/835 510/340 |
| 6,046,149 | A | 4/2000 | Sorrie et al. | |
| 6,479,448 | B2 | 11/2002 | Cropper et al. | |
| 6,521,581 | B1 | 2/2003 | Hsu et al. | |
| 6,727,215 | B2 | 4/2004 | Roberts et al. | |
| 6,878,679 | B2 | 4/2005 | Sommerville-Roberts et al. | |
| 7,259,134 | B2 | 8/2007 | Beckholt et al. | |
| 7,282,472 | B2 | 10/2007 | Kapur et al. | |
| 7,304,025 | B2 | 12/2007 | Hardy et al. | |
| 7,329,441 | B2 | 2/2008 | Catlin et al. | |
| 7,439,215 | B2 | 10/2008 | Catlin et al. | |
| 7,464,519 | B2 | 12/2008 | Fisher et al. | |
| 7,563,757 | B2 | 7/2009 | Kouvroukoglou et al. | |
| 7,595,290 | B2 | 9/2009 | Pounds et al. | |
| 8,551,929 | B2 | 10/2013 | Graham et al. | |
| 8,946,139 | B2 * | 2/2015 | Batchelor | C11D 3/382 510/343 |
| 2003/0114332 | A1 * | 6/2003 | Ramcharan | C11D 17/0004 510/296 |
| 2004/0167048 | A1 * | 8/2004 | Sunder | C11D 1/66 510/220 |
| 2005/0101505 | A1 * | 5/2005 | Wood | C11D 1/94 510/337 |
| 2006/0281658 | A1 * | 12/2006 | Kellar | C11D 3/046 510/438 |
| 2009/0192067 | A1 * | 7/2009 | Dery | C11D 1/65 510/330 |
| 2009/0253604 | A1 * | 10/2009 | Brooker | C11D 3/40 510/295 |
| 2011/0112005 | A1 * | 5/2011 | Brooker | C11D 1/29 510/321 |

(Continued)

FOREIGN PATENT DOCUMENTS

| | | |
|---|---|---|
| EP | 2746381 A1 | 6/2014 |
| JP | 58-217598 | 12/1983 |
| WO | 03052040 A1 | 6/2003 |
| WO | 2013119537 A1 | 8/2013 |

OTHER PUBLICATIONS

International Preliminary Report on Patentability and Written Opinion for International Application No. PCT/US2015/027114, The International Bureau of WIPO, Geneva, Switzerland, dated Oct. 25, 2016, 6 pages.

(Continued)

*Primary Examiner* — Gregory R Delcotto
(74) *Attorney, Agent, or Firm* — Bojuan Deng

(57) ABSTRACT

The present invention relates to unit dose detergent compositions comprising a water-soluble container formed from a water-soluble film material enclosing a liquid composition with a relatively high water content. In one embodiment, the unit dose detergent composition comprises a water-soluble container formed from a water-soluble film material enclosing a liquid composition, wherein the liquid composition comprises (a) at least one surfactant, (b) at least one humectant selected from the group consisting of polyols having 3 to 9 carbon atoms, and (c) about 15 wt % to about 35 wt % of water.

10 Claims, No Drawings

(56) References Cited

U.S. PATENT DOCUMENTS

| | | | | |
|---|---|---|---|---|
| 2012/0108487 | A1 | 5/2012 | Graham et al. | |
| 2012/0135910 | A1* | 5/2012 | Gross | C11D 1/83<br>510/296 |
| 2013/0313154 | A1* | 11/2013 | Hernandez | C11D 1/83<br>206/524.7 |
| 2014/0228274 | A1* | 8/2014 | Mikkelsen | C11D 1/22<br>510/393 |
| 2014/0274859 | A1* | 9/2014 | Adamy | C11D 1/02<br>510/296 |

OTHER PUBLICATIONS

International Search Report for International Application No. PCT/US2015/027114, ISA/US, Commissioner for Patents, Virginia, United States, dated Jul. 8, 2015, 3 pages.
Supplementary European Search Report EP 15 78 2687 Completed: Oct. 27, 2017 2 pages.

* cited by examiner

UNIT DOSE DETERGENT COMPOSITIONS

BACKGROUND OF THE INVENTION

Field of the Invention

This invention relates to unit dose detergent compositions comprising a water-soluble container formed from a water-soluble film material enclosing a liquid composition with a relatively high water content.

Background Art

Unit dose detergent products are often found by consumers to be preferable for use in automatic dishwashing and clothes washing applications. Such unit dose products have several advantages, including convenience of use and dispensing, lower cost per use, and avoiding or minimizing skin contact with potentially irritating cleaning compositions.

Unit dose systems that can be used in aqueous liquid detergent or cleaning compositions are known in the art. For example, U.S. Pat. No. 4,973,416 (the '416 patent) discloses unit dose liquid detergent compositions enclosed within a water-soluble polymeric film pouch, where the liquid compositions are concentrated and contain a substantially all-organic neutralization system. Although stating that water can be in an amount less than about 24 wt % of the liquid composition, the '416 patent indicates that a preferred amount is 18 wt %. Furthermore, the only example of unit dose liquid detergent disclosed in the '416 patent has a liquid detergent composition with a total water content of 16.29 wt %. The disclosure of the '416 patent is incorporated by reference herein.

U.S. Pat. No. 6,037,319 (the '319 patent) discloses water-soluble packets containing concentrated liquid cleaning compositions which contain less than about 10 wt % water. The '319 patent at column 3, lines 42-44 points out that "[i]t is preferred to limit the amount of water in the liquid cleaning concentrate to less than 10 wt. % of the composition." The disclosure of the '319 patent is incorporated by reference herein.

In addition, U.S. Pat. No. 7,563,757 (the '757 patent) discloses water soluble pouches containing liquid detergent compositions which contain a plasticizer, a viscosity modifier, and a relatively low level of water. The liquid compositions in the '757 patent contains less than 25 wt % water, and preferably between 5-15 wt % water, as indicated in column 2, lines 53-55. The disclosure of the '757 patent is incorporated by reference herein.

One limitation of these known unit dose detergent compositions is that the water content of the liquid detergent compositions is limited to a relatively low level to prevent the water-soluble film from being dissolved pre-maturely by the enclosed liquid detergent composition. Water is an inexpensive ingredient of the liquid detergent compositions and a ubiquitous solvent. There still remains a need for unit dose detergent compositions having a relatively high water content, which would reduce the cost of goods while increasing formulation flexibility of the unit dose detergent compositions.

BRIEF SUMMARY OF THE INVENTION

In one embodiment, the invention is a unit dose detergent composition, comprising: a water-soluble container formed from a water-soluble film material enclosing a liquid composition, wherein the liquid composition comprises:

a) at least one surfactant, b) at least one humectant selected from the group consisting of polyols having 3 to 9 carbon atoms, and c) about 25 wt % to about 35 wt % of water.

In one embodiment, the humectant is hexylene glycol. In another embodiment, the humectant is propylene glycol, glycerol, or a combination thereof.

In one embodiment, the at least one surfactant is an anionic surfactant, a nonionic surfactant, a cationic surfactant, an ampholytic surfactant, a zwitterionic surfactant, or a mixture thereof.

In one embodiment, the at least one surfactant is an anionic surfactant. In one embodiment, the at least one surfactant is a sulfate anionic surfactant.

In another embodiment, the liquid compositions of the present invention may contain about 5 wt % to about 50 wt % of one or more anionic surfactants, preferably about 10 wt % to about 35 wt %, more preferably about 15 wt % to about 30 wt %, most preferably about 30 wt % to about 50 wt %.

In another embodiment, the liquid compositions of the present invention may contain about 5 wt % to about 75 wt % of one or more humectants, preferably about 7 wt % to about 50 wt %, more preferably about 10 wt % to about 40 wt %.

In another embodiment, the at least one surfactant is an alkyl ether sulfate (AES). In another embodiment, the at least one surfactant is sodium lauryl ether sulfate (SLES).

In one embodiment, the at least one surfactant is a nonionic surfactant. In one embodiment, the nonionic surfactant is selected from a group consisting of polyalkoxylated alkanolamides, polyoxyalkylene alkyl ethers, polyoxyalkylene alkylphenyl ethers, polyoxyalkylene sorbitan fatty acid esters, polyoxyalkylene sorbitol fatty acid esters, polyalkylene glycol fatty acid esters, alkyl polyalkylene glycol fatty acid esters, polyoxyethylene polyoxypropylene alkyl ethers, polyoxyalkylene castor oils, polyoxyalkylene alkylamines, glycerol fatty acid esters, alkylglucosamides, alkylglucosides, alkylamine oxides, amine oxide surfactants, alkoxylated fatty alcohols, ethylene oxide (EO)-propylene oxide (PO) block polymers, and a mixture thereof.

In another embodiment, the water-soluble film material is selected from the group consisting of polyvinyl alcohol (PVA), polyvinyl pyrrolidone, polyalkylene oxide, polyacrylamide, poly acrylic acid, cellulose, cellulose ether, cellulose ester, cellulose amide, polyvinyl acetate, polycarboxylic acid and salt, polyaminoacid, polyamide, polyanhydride copolymer of maleic/acrylic acid, polysaccharide, natural gums, polyacrylate, water-soluble acrylate copolymer, methylcellulose, carboxymethylcellulose sodium, dextrin, ethylcellulose, hydroxyethyl cellulose, maltodextrin, polymethacrylate, polyvinyl alcohol copolymer, hydroxypropyl methyl cellulose (HPMC), and a mixture thereof.

In another embodiment, the liquid composition comprises about 25 wt % to about 30 wt % of water.

In another embodiment, the liquid composition comprises about 25 wt % to about 28 wt % of water.

In another embodiment, the liquid composition comprises about 25 wt % to about 26 wt % of water.

In another embodiment, the liquid composition comprises about 25 wt % of water.

In one embodiment, the invention is a unit dose detergent composition, comprising: a water-soluble container formed from a water-soluble film material enclosing a liquid composition, wherein the liquid composition comprises:

a) at least one alkyl ether sulfate (AES), b) at least one humectant selected from the group consisting of polyols having 4 to 8 carbon atoms, and c) about 15 wt % to about 35 wt % of water.

In one embodiment, the at least one humectant is hexylene glycol.

In one embodiment, the at least one alkyl ether sulfate (AES) is sodium lauryl ether sulfate (SLES).

In another embodiment, the liquid compositions of the present invention may contain about 5 wt % to about 25 wt % of one or more alkyl ether sulfates (AES), preferably about 10 wt % to about 22 wt %, more preferably about 15 wt % to about 20 wt %.

In another embodiment, the liquid compositions of the present invention may contain about 5 wt % to about 75 wt % of one or more humectant, preferably about 7 wt % to about 50 wt %, more preferably about 10 wt % to about 40 wt %.

In another embodiment, the water-soluble film material is selected from the group consisting of polyvinyl alcohol (PVA), polyvinyl pyrrolidone, polyalkylene oxide, polyacrylamide, poly acrylic acid, cellulose, cellulose ether, cellulose ester, cellulose amide, polyvinyl acetate, polycarboxylic acid and salt, polyaminoacid, polyamide, polyanhydride copolymer of maleic/acrylic acid, polysaccharide, natural gums, polyacrylate, water-soluble acrylate copolymer, methylcellulose, carboxymethylcellulose sodium, dextrin, ethylcellulose, hydroxyethyl cellulose, maltodextrin, polymethacrylate, polyvinyl alcohol copolymer, hydroxypropyl methyl cellulose (HPMC), and a mixture thereof.

In another embodiment, the liquid composition comprises about 17 wt % to about 35 wt % of water.

In another embodiment, the liquid composition comprises about 20 wt % to about 35 wt % of water.

In another embodiment, the liquid composition comprises about 20 wt % to about 30 wt % of water.

In another embodiment, the liquid composition comprises about 22 wt % to about 28 wt % of water.

In another embodiment, the liquid composition comprises about 24 wt % to about 26 wt % of water.

In another embodiment, the liquid composition comprises about 25 wt % water.

In another embodiment, the liquid composition comprises about 17 wt % of sodium lauryl ether sulfate (SLES), about 15 wt % of hexylene glycol, and about 25 wt % of water.

DETAILED DESCRIPTION OF THE INVENTION

The following description provides specific details, such as materials and amounts, to provide a thorough understanding of the present invention. The skilled artisan, however, will appreciate that the present invention can be practiced without employing these specific details. Indeed, the present invention can be practiced in conjunction with processing, manufacturing or fabricating techniques conventionally used in the detergent industry.

The wt % in the specification refers to the weight percentage of an ingredient as compared to the total weight of the liquid composition. For example, the wt % of sodium lauryl ether sulfate (SLES) refers to the weight percentage of the active SLES in the composition. The wt % of the total water in the liquid composition is calculated based on all the water including those added as a part of individual ingredients. When an ingredient added to make the liquid composition is not 100% pure and used as a mixture, e.g., in a form of a solution, the wt % of that material added refers to the weight percentage of the mixture.

Surfactants

Useful surfactants in the liquid compositions of the present invention include, for example, an anionic surfactant, a nonionic surfactant, a cationic surfactant, an ampholytic surfactant, a zwitterionic surfactant, or mixtures thereof.

Anionic Surfactants

Suitable anionic surfactants includes but not limited to those surfactants that contain a long chain hydrocarbon hydrophobic group in their molecular structure and a hydrophilic group, i.e., water solubilizing group including salts such as carboxylate, sulfonate, sulfate, or phosphate groups. Suitable anionic surfactant salts include sodium, potassium, calcium, magnesium, barium, iron, ammonium and amine salts. Other suitable secondary anionic surfactants include the alkali metal, ammonium and alkanol ammonium salts of organic sulfuric reaction products having in their molecular structure an alkyl, or alkaryl group containing from 8 to 22 carbon atoms and a sulfonic or sulfuric acid ester group.

In one embodiment, the anionic surfactant is a polyethoxylated alcohol sulfate, such as those sold under the trade name CALFOAM® 303 (Pilot Chemical Company, California). Such materials, also known as alkyl ether sulfates (AES) or alkyl polyethoxylate sulfates, are those which correspond to the following formula (I):

$$R'—O—(C_2H_4O)_n—SO_3M' \quad (I)$$

wherein R' is a $C_8$-$C_{20}$ alkyl group, n is from 1 to 20, and M' is a salt-forming cation; preferably, R' is $C_{10}$-$C_{18}$ alkyl, n is from 1 to 15, and M' is sodium, potassium, ammonium, alkylammonium, or alkanolammonium. In another embodiment, R' is a $C_{12}$-$C_{16}$ alkyl, n is from 1 to 6 and M' is sodium. In another embodiment, the alkyl ether sulfate is sodium lauryl ether sulphate (SLES).

The alkyl ether sulfates will generally be used in the form of mixtures comprising varying R' chain lengths and varying degrees of ethoxylation. Frequently such mixtures will inevitably also contain some unethoxylated alkyl sulfate materials, i.e., surfactants of the above ethoxylated alkyl sulfate formula wherein n=0. Unethoxylated alkyl sulfates may also be added separately to the liquid compositions of this invention. Suitable unalkoxylated, e.g., unethoxylated, alkyl ether sulfate surfactants are those produced by the sulfation of higher $C_8$-$C_{20}$ fatty alcohols. Conventional primary alkyl sulfate surfactants have the general formula of: $ROSO_3M$, wherein R is typically a linear $C_8$-$C_{20}$ hydrocarbyl group, which may be straight chain or branched chain, and M is a water-solubilizing cation; preferably R is a $C_{10}$-$C_{15}$ alkyl, and M is alkali metal. In one embodiment, R is $C_{12}$-$C_{14}$ and M is sodium. Examples of other anionic surfactants are disclosed in U.S. Pat. No. 3,976,586, the disclosure of which is incorporated by reference herein.

In one embodiment, the anionic surfactant is a water soluble salt of an alkyl benzene sulfonate having between 8 and 22 carbon atoms in the alkyl group. In one embodiment, the anionic surfactant comprises an alkali metal salt of $C_{10-16}$ alkyl benzene sulfonic acids, such as $C_{11-14}$ alkyl benzene sulfonic acids. In one embodiment, the alkyl group is linear and such linear alkyl benzene sulfonates are known in the art as "LAS." Other suitable anionic surfactants include sodium and potassium linear, straight chain alkylbenzene sulfonates in which the average number of carbon atoms in the alkyl group is between 11 and 14. Sodium $C_{11}$-$C_{14}$, e.g., $C_{12}$, LAS is one suitable anionic surfactant for use herein.

In one embodiment, the anionic surfactant is at least one α-sulfofatty acid ester. Such a sulfofatty acid is typically formed by esterifying a carboxylic acid with an alkanol and then sulfonating the α-position of the resulting ester. The α-sulfofatty acid ester is typically of the following formula (II):

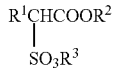

(II)

wherein $R^1$ is a linear or branched alkyl, $R^2$ is a linear or branched alkyl, and $R^3$ is hydrogen, a halogen, a monovalent or di-valent cation, or an unsubstituted or substituted ammonium cation. $R^1$ can be a $C_4$ to $C_{24}$ alkyl, including a $C_{10}$, $C_{12}$, $C_{14}$, $C_{16}$ and/or $C_{18}$ alkyl. $R^2$ can be a $C_1$ to $C_8$ alkyl, including a methyl group. $R^3$ is typically a monovalent or di-valent cation, such as a cation that forms a water soluble salt with the α-sulfofatty acid ester (e.g., an alkali metal salt such as sodium, potassium or lithium). The α-sulfofatty acid ester of formula (II) can be a methyl ester sulfonate, such as a $C_{16}$ methyl ester sulfonate, a $C_{18}$ methyl ester sulfonate, or a mixture thereof. In another embodiment, the α-sulfofatty acid ester of formula (II) can be a methyl ester sulfonate, such as a mixture of $C_{12}$-$C_{18}$ methyl ester sulfonates.

More typically, the α-sulfofatty acid ester is a salt, which is generally of the following formula (III):

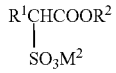

(III)

wherein $R^1$ and $R^2$ are linear or branched alkyls and $M^2$ is a monovalent metal. $R^1$ can be a $C_4$ to $C_{24}$ alkyl, including a $C_{10}$, $C_{12}$, $C_{14}$, $C_{16}$ and/or $C_{18}$ alkyl. $R^2$ can be a $C_1$ to $C_8$ alkyl, including a methyl group. $M^2$ is typically an alkali metal, such as sodium or potassium. The α-sulfofatty acid ester of formula (III) can be a sodium methyl ester sulfonate, such as a sodium $C_8$-$C_{18}$ methyl ester sulfonate.

In one embodiment, the liquid composition comprises about 5 wt % to about 50 wt % of one or more anionic surfactants, preferably about 10 wt % to about 35 wt %, more preferably about 15 wt % to about 35 wt %, Nonionic Surfactants Suitable nonionic surfactants include but not limited to alkoxylated fatty alcohols, ethylene oxide (EO)-propylene oxide (PO) block polymers, and amine oxide surfactants. Suitable for use in the liquid compositions herein are those nonionic surfactants which are normally liquid. Suitable nonionic surfactants for use herein include the alcohol alkoxylate nonionic surfactants. Alcohol alkoxylates are materials which correspond to the general formula of: $R^9(C_mH_{2m}O)_nOH$, wherein $R^9$ is a linear or branched $C_8$-$C_{16}$ alkyl group, m is from 2 to 4, and n ranges from 2 to 12; alternatively $R^9$ is a linear or branched $C_{9-15}$ or $C_{10-14}$ alkyl group. In another embodiment, the alkoxylated fatty alcohols will be ethoxylated materials that contain from 2 to 12, or 3 to 10, EO moieties per molecule. The alkoxylated fatty alcohol materials useful in the liquid compositions herein will frequently have a hydrophilic-lipophilic balance (HLB) which ranges from 3 to 17, from 6 to 15, or from 8 to 15. Alkoxylated fatty alcohol nonionic surfactants have been marketed under the tradenames Neodol and Dobanol by the Shell Chemical Company. Another nonionic surfactant suitable for use includes ethylene oxide (EO)-propylene oxide (PO) block polymers, such as those marketed under the tradename Pluronic. These materials are formed by adding blocks of ethylene oxide moieties to the ends of polypropylene glycol chains to adjust the surface active properties of the resulting block polymers. In one embodiment, the nonionic surfactant is $C_{12}$-$C_{15}$ alcohol ethoxylate 7EO.

Another example of a nonionic surfactant is alkoxylated, preferably ethoxylated or ethoxylated and propoxylated fatty acid alkyl esters, having from 1 to 4 carbon atoms in the alkyl chain, especially fatty acid methyl esters, as described, for example, in JP58/217598. In one embodiment, the nonionic surfactant is methyl ester ethoxylate.

Suitable nonionic surfactants also include polyalkoxylated alkanolamides, which are generally of the following formula (IV):

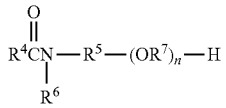

(IV)

wherein $R^4$ is an alkyl or alkoxy, $R^5$ and $R^7$ are alkyls and n is a positive integer. $R^4$ is typically an alkyl containing 6 to 22 carbon atoms. $R^5$ is typically an alkyl containing 1-8 carbon atoms. $R^7$ is typically an alkyl containing 1 to 4 carbon atoms, and more typically an ethyl group. The degree of polyalkoxylation (the molar ratio of the oxyalkyl groups per mole of alkanolamide) typically ranges from about 1 to about 100, or from about 3 to about 8, or about 5 to about 6. $R^6$ can be hydrogen, an alkyl, an alkoxy group or a polyalkoxylated alkyl. The polyalkoxylated alkanolamide is typically a polyalkoxylated mono- or di-alkanolamide, such as a $C_{16}$ and/or $C_{18}$ ethoxylated monoalkanolamide, or an ethoxylated monoalkanolamide prepared from palm kernel oil or coconut oil.

Other suitable nonionic surfactants include those containing an organic hydrophobic group and a hydrophilic group that is a reaction product of a solubilizing group (such as a carboxylate, hydroxyl, amido or amino group) with an alkylating agent, such as ethylene oxide, propylene oxide, or a polyhydration product thereof (such as polyethylene glycol). Such nonionic surfactants include, for example, polyoxyalkylene alkyl ethers, polyoxyalkylene alkylphenyl ethers, polyoxyalkylene sorbitan fatty acid esters, polyoxyalkylene sorbitol fatty acid esters, polyalkylene glycol fatty acid esters, alkyl polyalkylene glycol fatty acid esters, polyoxyethylene polyoxypropylene alkyl ethers, polyoxyalkylene castor oils, polyoxyalkylene alkylamines, glycerol fatty acid esters, alkylglucosamides, alkylglucosides, and alkylamine oxides. Other suitable surfactants include those disclosed in U.S. Pat. Nos. 5,945,394 and 6,046,149, the disclosures of which are incorporated herein by reference. In another embodiment, the composition is substantially free of nonylphenol nonionic surfactants. In this context, the term "substantially free" means less than about one weight percent.

Yet another nonionic surfactant useful herein comprises amine oxide surfactants. Amine oxides are often referred to in the art as "semi-polar" nonionics, and have the following formula (V):

$$R^{10}(EO)_x(PO)_y(BO)_zN(O)(CH_2R^{11})_2.qH_2O \quad (V)$$

wherein $R^{10}$ is a relatively long-chain hydrocarbyl moiety which can be saturated or unsaturated, linear or branched, and can typically contain from 8 to 20, from 10 to 16 carbon atoms, or a $C_{12}$-$C_{16}$ primary alkyl. $R^{11}$ is a short-chain moiety such as a hydrogen, methyl and —$CH_2OH$. When x+y+z is different from 0, EO is ethyleneoxy, PO is propyleneoxy and BO is butyleneoxy. q is the number of water molecules in the surfactant. In one embodiment, the nonionic surfactant is $C_{2-14}$ alkyldimethyl amine oxide.

In one embodiment, the liquid composition comprises about 15 wt % to about 65 wt % of one or more nonionic surfactants, preferably about 18 wt % to about 40 wt %, more preferably about 18 wt % to about 25 wt %, Zwitterionic Surfactants Suitable zwitterionic surfactants include but not limited to derivatives of secondary and tertiary amines, derivatives of heterocyclic secondary and tertiary amines, or derivatives of quaternary ammonium, quaternary phosphonium or tertiary sulfonium compounds, such as those disclosed in U.S. Pat. No. 3,929,678, which is incorporated by reference herein.

Cationic Surfactants

Suitable cationic surfactants include but not limited to quaternary ammonium surfactants. Suitable quaternary ammonium surfactants include mono $C_6$-$C_{16}$, or $C_6$-$C_{10}$ N-alkyl or alkenyl ammonium surfactants, wherein the remaining N positions are substituted by, e.g., methyl, hydroxyethyl or hydroxypropyl groups. Another cationic surfactant is $C_6$-$C_{18}$ alkyl or alkenyl ester of an quaternary ammonium alcohol, such as quaternary chlorine esters. In another embodiment, the cationic surfactants have the following formula (VI):

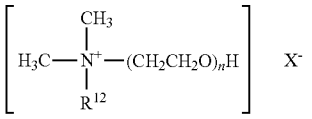

(VI)

wherein $R^{12}$ is $C_8$-$C_{18}$ hydrocarbyl and mixtures thereof, or $C_{8-14}$ alkyl, or $C_8$, $C_{10}$ or $C_{12}$ alkyl, X is an anion such as chloride or bromide, and n is a positive integer.

Other suitable surfactants include amphoteric surfactants. Suitable amphoteric surfactants for uses herein include amido propyl betaines and derivatives of aliphatic or heterocyclic secondary and ternary amines in which the aliphatic moiety can be straight chain or branched and wherein one of the aliphatic substituents contains from 8 to 24 carbon atoms and at least one aliphatic substituent contains an anionic water-solubilizing group. When present, amphoteric surfactants typically comprise from 0.01 wt % to 20 wt %, or from 0.5 wt % to 10 wt % of the liquid composition of the invention.

In one embodiment, the surfactant of the liquid composition of the invention comprises an anionic surfactant, a nonionic surfactant, or mixtures thereof. In another embodiment, the anionic surfactant is alkyl benzene sulfonic acid, methyl ester sulfate, sodium lauryl ether sulfate, or mixtures thereof. In another embodiment, the nonionic surfactant is alcohol ethoxylate, methyl ester ethoxylate, or mixtures thereof.

In one embodiment, the surfactant is a mixture of at least one anionic and at least one nonionic surfactant. In another embodiment, the anionic surfactant is sodium lauryl ether sulfate. In another embodiment, the surfactant is a mixture of at least two anionic surfactants. In one embodiment, the surfactant comprises a mixture of an alkyl benzene sulfonate and an alkyl ether sulfate. In another embodiment, and the alkyl ether sulfate is sodium lauryl ether sulphate (SLES).

In certain embodiments, the surfactant comprises about 15 wt % to about 30 wt % of an anionic surfactant selected from the group consisting of alkyl benzene sulfonate, methyl ester sulfonate, sodium lauryl ether sulphate, and mixtures thereof, and about 15 wt % to about 30 wt % of an nonionic surfactant selected from the group consisting of alcohol ethoxylate, methyl ester ethoxylate, and mixtures thereof.

Humectants

A humectant, for purposes of the present invention, is a substance that exhibits high affinity for water, especially attracting water for moisturization and solubilization purposes. The water is absorbed into the humectant; not merely adsorbed at a surface layer. The water absorbed by the humectant is available to the system; it is not too tightly bound to the humectant. For example, in a skin lotion, the humectant attracts moisture from the surrounding atmosphere while reducing transepidermal water loss, and makes the water available to the skin barrier. Similarly, the humectant in a single dose liquid formula will not trap all the water needed for solubilization of other formula components—it will help to maintain the water balance between the formula, the film, and the atmosphere. These humectants possess hydrophilic groups which form hydrogen bonds with water. Common hydrophilic groups include hydroxyl, carboxyl, ester, and amine functionalities. A humectant can thus act as a solubilizer and moisture regulator in a unit dose formulation. Useful humectants include but not limited to polyols.

The polyol (or polyhydric alcohol) may be a linear or branched alcohol with two or more hydroxyl groups. Thus diols with two hydroxyl groups attached to separate carbon atoms in an aliphatic chain may also be used. The polyol typically includes less than 9 carbon atoms, such as 9, 8, 7, 6, 5, 4, 3, or 2 carbon atoms. Preferably, the polyol includes 3 to 8 carbon atoms. More preferably, the polyol includes 3 to 6 carbon atoms. The molecular weight is typically less than 500 g/mol, such as less than 400 g/mol or less than 300 g/mol.

Examples of suitable polyols include, but not limited to, propylene glycol, butylene glycol, pentylene glycol, hexylene glycol, heptylene glycol, octylene glycol, 2-methyl-1,3-propanediol, xylitol, sorbitol, mannitol, diethylene glycol, triethylene glycol, glycerol, erythritol, dulcitol, inositol, and adonitol.

The liquid compositions of the present invention may contain about 5 wt % to about 75 wt % of one or more humectants, preferably about 7 wt % to about 50 wt %, more preferably about 10 wt % to about 40 wt %.

In one embodiment, the liquid composition comprises about 15 wt % of hexylene glycol.

The liquid composition may further contain additional components including but limited to those listed below.

Other Components

The liquid composition of the present invention optionally comprises other ingredients that can typically be present in detergent products and/or personal care products to provide further benefits in terms of cleaning power, solubilization, appearance, fragrance, etc.

Builders

Other suitable components include organic or inorganic detergency builders. Examples of water-soluble inorganic builders that can be used, either alone or in combination with themselves or with organic alkaline sequestrant builder salts, are glycine, alkyl and alkenyl succinates, alkali metal carbonates, alkali metal bicarbonates, phosphates, polyphosphates and silicates. Specific examples of such salts are sodium tripolyphosphate, sodium carbonate, potassium carbonate, sodium bicarbonate, potassium bicarbonate, sodium pyrophosphate and potassium pyrophosphate. Examples of organic builder salts that can be used alone, or in combination with each other, or with the preceding inorganic alkaline builder salts, are alkali metal polycarboxylates, water-soluble citrates such as sodium and potassium citrate, sodium and potassium tartrate, sodium and potassium ethylenediaminetetracetate, sodium and potassium N-(2-hydroxyethyl)-nitrilo triacetates, sodium and potassium N-(2-hydroxyethyl)-nitrilo diacetates, sodium and potassium oxydisuccinates, and sodium and potassium tartrate mono- and di-succinates, such as those described in U.S. Pat. No. 4,663,071, the disclosure of which is incorporated herein by reference.

Enzymes

Suitable enzymes include those known in the art, such as amylolytic, proteolytic, cellulolytic or lipolytic type, and those listed in U.S. Pat. No. 5,958,864, the disclosure of which is incorporated herein by reference. One protease, sold under the trade name SAVINASE® by Novozymes A/S, is a subtillase from *Bacillus lentus*. Other suitable enzymes include proteases, amylases, lipases and cellulases, such as ALCALASE® (bacterial protease), EVERLASE® (protein-engineered variant of SAVINASE®), ESPERASE® (bacterial protease), LIPOLASE® (fungal lipase), LIPOLASE ULTRA (Protein-engineered variant of LIPOLASE), LIPOPRIME® (protein-engineered variant of LIPOLASE), TERMAMYL® (bacterial amylase), BAN (Bacterial Amylase Novo), CELLUZYME® (fungal enzyme), and CAREZYME® (monocomponent cellulase), sold by Novozymes A/S. Additional enzymes of these classes suitable for use in accordance with the present invention will be well-known to those of ordinary skill in the art, and are available from a variety of commercial suppliers including but not limited to Novozymes A/S and Genencor/Danisco.

Foam Stabilizers

Suitable foam stabilizing agents include but not limited to a polyalkoxylated alkanolamide, amide, amine oxide, betaine, sultaine, $C_8$-$C_{18}$ fatty alcohols, and those disclosed in U.S. Pat. No. 5,616,781, the disclosure of which is incorporated by reference herein. Foam stabilizing agents are used, for example, in amounts of about 1 wt % to about 20 wt %, typically about 3 wt % to about 5 wt %. The composition can further include an auxiliary foam stabilizing surfactant, such as a fatty acid amide surfactant. Suitable fatty acid amides are $C_8$-$C_{20}$ alkanol amides, monoethanolamides, diethanolamides, and isopropanolamides.

Colorants

In some embodiments, the liquid composition does not contain a colorant.

In some embodiments, the liquid composition contains one or more colorants. The colorant(s) can be, for example, polymers. The colorant(s) can be, for example, dyes. The colorant(s) can be, for example, water-soluble polymeric colorants.

The colorant(s) can be, for example, water-soluble dyes. The colorant(s) can be, for example, colorants that are well-known in the art or commercially available from dye or chemical manufacturers.

The color of the colorant(s) is not limited, and can be, for example, red, orange, yellow, blue, indigo, violet, or any combination thereof. The colorant(s) can be, for example, one or more Milliken LIQUITINT colorants. The colorant(s) can be, for example Milliken LIQUITINT: VIOLET LS, ROYAL MC, BLUE HP, BLUE MC, AQUAMARINE, GREEN HMC, BRIGHT YELLOW, YELLOW LP, YELLOW BL, BRILLIANT ORANGE, CRIMSON, RED MX, PINK AL, RED BL, RED ST, or any combination thereof.

The colorant(s) can be, for example, one or more of Acid Blue 80, Acid Red 52, and Acid Violet 48.

Acid Blue 80 has the chemical structure:

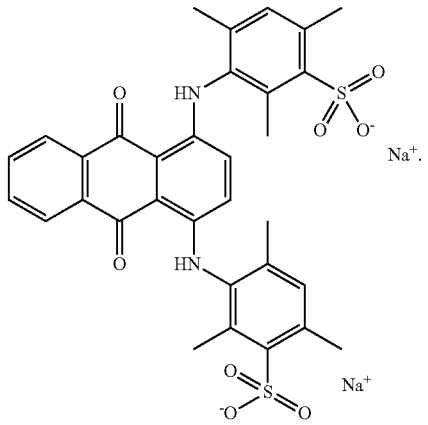

Acid Red 52 has the chemical structure:

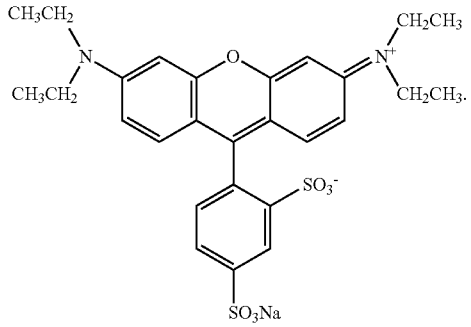

Acid Violet 48 has the chemical structure:

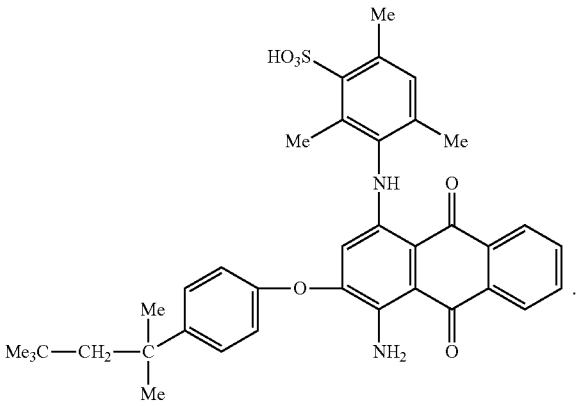

When the colorant(s) are selected from the group consisting of Acid Blue 80, Acid Red 52, and Acid Violet 48, the liquid composition, optionally, does not contain a colorant stabilizer. Surprisingly, it has been found that Acid Blue 80, Acid Red 52, and Acid Violet 48, do not display significant discoloration over time, and thus, can be used without (e.g., in the absence of) a colorant stabilizer.

The total amount of the one or more colorant(s) that can be contained in the liquid composition, for example, can range from about 0.00001 wt % to about 0.099 wt %. The total amount of colorant(s) in the liquid composition can be, for example, about 0.0001 wt %, about 0.001 wt %, about 0.01 wt %, about 0.05 wt %, or about 0.08 wt %.

Colorant Stabilizer(s)

In some embodiments, the liquid composition can optionally contain a colorant stabilizer. In some embodiments, the colorant stabilizer can be citric acid.

The total amount of the optionally present colorant stabilizer(s) in the liquid composition can range, for example, from about 0.01 wt % to about 5.0 wt %. The total amount of the colorant stabilizer(s) in the liquid composition can be, for example, about 0.1 wt %, about 1 wt %, about 2 wt %, about 3 wt %, or about 4 wt %.

Perfumes

The liquid compositions of the invention may optionally include one or more perfumes or fragrances. As used herein, the term "perfume" is used in its ordinary sense to refer to and include any fragrant substance or mixture of substances including natural (obtained by extraction of flowers, herbs, leaves, roots, barks, wood, blossoms or plants), artificial (mixture of natural oils or oil constituents) and synthetically produced odoriferous substances. Typically, perfumes are complex mixtures of blends of various organic compounds such as alcohols, aldehydes, ethers, aromatic compounds and varying amounts of essential oils (e.g., terpenes) such as from 0 wt % to 80 wt %, usually from 1 wt % to 70 wt %, the essential oils themselves being volatile odoriferous compounds and also serving to dissolve the other components of the perfume. Suitable perfume ingredients include those disclosed in "Perfume and Flavour Chemicals (Aroma Chemicals)", published by Steffen Arctander (1969), which is incorporated herein by reference. Perfumes can be present from about 0.1 wt % to about 10 wt %, and preferably from about 0.5 wt % to about 5 wt % of the composition.

Other Optional Ingredients

The liquid compositions may also contain one or more optional ingredients conventionally included in detergent compositions such as a pH buffering agent, a perfume carrier, a fluorescer, a hydrotrope, an antifoaming agent, an antiredeposition agent, a polyelectrolyte, an optical brightening agent, a pearlescer, an anti-shrinking agent, an anti wrinkle agent, an anti-spotting agent, a germicide, a fungicide, an anticorrosion agent, a drape imparting agent, an anti-static agent, an ironing aids crystal growth inhibitor, an anti-oxidant, an anti-reducing agent, a chelating agent, a dispersing agent, a defoamer, a color component, a fragrance component, a bleaching catalyst, a bleaching agent, a bleach activator, a whitening agent, a brightening agent, an anticorrosion agent, a deodorizing agent, a color/texture rejuvenating agent, a soil releasing polymer, a preservative, a bittering agent, and a mixture thereof. Examples and sources of suitable such components are well-known in the art and/or are described herein. For example, a preferred soil releasing polymer is polyethylene imine ethoxylated, sold under tradename Sokalan® HP 20 (BASF). A preferred bittering agent is denatonium benzoate, sold under the tradename Bitrex® (Johnson Matthey).

Water-Soluble Container

The unit dose detergent compositions of the present invention include a water-soluble container. The water soluble container is made from a water-soluble material which dissolves, ruptures, disperses, or disintegrates upon contact with water, releasing thereby the liquid composition. In one embodiment, the water soluble container is made from a lower molecular weight water-soluble polyvinyl alcohol film-forming resin.

In some embodiments, the water soluble container is formed from a water soluble polymer selected from the group consisting of polyvinyl alcohol (PVA), polyvinyl pyrrolidone, polyalkylene oxide, polyacrylamide, poly acrylic acid, cellulose, cellulose ether, cellulose ester, cellulose amide, polyvinyl acetate, polycarboxylic acid and salt, polyaminoacid, polyamide, polyanhydride copolymer of maleic/acrylic acid, polysaccharide, natural gums, polyacrylate, water-soluble acrylate copolymer, methylcellulose, carboxymethylcellulose sodium, dextrin, ethylcellulose, hydroxyethyl cellulose, maltodextrin, polymethacrylate, polyvinyl alcohol copolymer, hydroxypropyl methyl cellulose (HPMC), and a mixture thereof.

Unit dose containers and methods of manufacture thereof that are suitable for use with the compositions of the present invention include those described, for example, in U.S. Pat. Nos. 3,218,776; 4,776,455; 4,973,416; 6,479,448; 6,727,215; 6,878,679; 7,259,134; 7,282,472; 7,304,025; 7,329,441; 7,439,215; 7,464,519; 7,595,290; 8,551,929; the disclosures of all of which are incorporated herein by reference in their entireties. In some embodiments, the container is a water-soluble, single-chamber container, prepared from a water-soluble film. According to one such aspect of the invention, the single-chamber container is a formed, sealed pouch produced from a water-soluble polymer or film such as polyvinylalcohol (PVA) or a PVA film.

Preferred water soluble polymers for forming the pouch are polyvinyl alcohol (PVA) resins sold under tradename MonoSol® (MonoSol LLC, Indiana). The preferred grade is MonoSol® film having a weight average molecular weight range of about 55,000 to 65,000 and a number average molecular weight range of about 27,000 to 33,000. Preferably, the film material will have a thickness of approximately 3 mil or 75 micrometers. Alternatively, commercial grade PVA films are suitable for use in the present invention, such as those that are commercially available from Monosol (Merrillville, Ind.) (e.g., Monosol film M8310) or from Aicello (Aiichi, Japan; North American subsidiary in North Vancouver, BC, Canada) (e.g., Aicello GA or Aicello GS).

In some embodiments, the water soluble container further comprises a cross-linking agent. In some embodiments, the cross-linking agent is selected from the group consisting of formaldehyde, polyesters, epoxides, isocyanates, vinyl esters, urethanes, polyimides, acrylics with hydroxyl, carboxylic, isocyanate or activated ester groups, bis(methacryloxypropyl)tetramethylsiloxane (styrenes, methylmethacrylates), n-diazopyruvates, phenylboronic acids, cis-platin, divinylbenzene (styrenes, double bonds), polyamides, dialdehydes, triallyl cyanurates, N-(2-ethanesulfonylethyl)pyridinium halides, tetraalkyltitanates, titanates, borates, zirconates, or mixtures thereof. In one embodiment, the cross-linking agent is boric acid or sodium borate.

In additional embodiments, the water-soluble container or film from which it is made can contain one or more additional components, agents or features, such as one or more perfumes or fragrances, one or more enzymes, one or more surfactants, one or more rinse agents, one or more dyes, one or more functional or aesthetic particles, and the like. Such components, agents or features can be incorporate into or on the film when it is manufactured, or are conveniently introduced onto the film during the process of manufacturing the liquid composition of the present invention, using methods that are known in the film-producing arts.

The single-compartment, water-soluble container (e.g., pouch) used in association with the present invention may be in any desirable shape and size and may be prepared in any suitable way, such as via molding, casting, extruding or blowing, and is then filled using an automated filling process. Examples of processes for producing and filling water-soluble containers, suitable for use in accordance with the present invention, are described in U.S. Pat. Nos. 3,218,776; 3,453,779; 4,776,455; 5,699,653; 5,722,217; 6,037,319; 6,727,215; 6,878,679; 7,259,134; 7,282,472; 7,304,025; 7,329,441; 7,439,215; 7,464,519; and 7,595,290; the disclosures of all of which are incorporated herein by reference in their entireties. In preferred embodiments, the pouches are filled with the liquid composition of the present invention using the cavity filling approach described in U.S. Pat. Nos. 3,218,776 and 4,776,455. The machinery necessary for carrying out this process is commercially available, e.g., from Cloud Packaging Solutions (Des Plaines, Ill.; a division of Hearthside Food Solutions LLC).

Stability Testing

The stability of the unit dose detergent compositions (pouches) can be tested according to the following protocol. Pouches are placed into controlled temperature environment (rooms or chambers) at various temperatures, e.g., 27° F. (−3° C.), 40° F. (4° C.), 75° F. (23.9° C.), 105° F. (40.6° C.) and 125° F. (51.7° C.), and observations and analyses are performed over a period of time, e.g., 1 week, 2 weeks, 4 weeks, 6 weeks, 8 weeks, and 12 weeks. In the case of the freezing/thawing condition, there can be multiple pouches for the different cycles. Pouches are carefully examined and evidence of instability is monitored. This evidence includes, but not limited to: film fusion (film of individual pouch either fusing to other pouch or the packaging container), leakers (breaks/punctures in the pouch allowing for the liquid product to leak out), distortions in the film (coloring, brittleness, dryness, floppiness, breaks), discoloration of the product, changes in odor, suspended material, haziness, separation, precipitation, gel formation and cloudiness/opacity.

Physical analyses of the samples are taken for evidence of fluctuation in, e.g., viscosity, pH, specific gravity, moisture content. These analyses focus on the stability of the formula itself and its interaction with the film under varying conditions. Additional testing can also be performed at certain checkpoints during the 12 weeks. These tests include but not limited to: burst testing, dissolution testing, and seal testing. These tests focus on stability of the film itself over the course of time under varying conditions.

Also, outside the standard stability chamber conditions, to simulate extreme conditions, pouches are placed into designated humidity chambers for testing. These tests focus on all aspects of the pouch, formula stability as well as film stability, and how well it maintains its original form under harsh conditions. The humidity chambers include 77° F./65% humidity, 105° F./80% humidity, and 12°5F/20% humidity. The pouches are pulled and read weekly, because of how harsh the conditions are, and only kept in the chambers for a maximum of 4 weeks.

Unit dose detergent compositions of the present invention preferably demonstrate acceptable stability over the entire duration of these tests.

Other embodiments of the present invention are exemplified in the following examples, which illustrate embodiments according to the present invention, although the invention is not intended to be limited by or to these examples.

EXAMPLES

The following examples will further illustrate the present invention. The liquid compositions are made by combining the listed material in the listed proportions (wt % unless otherwise specified). Example compositions 1 to 8 exemplify compositions according to the present invention but are not necessarily used to limit or otherwise define the scope of the present invention.

All of the exemplified liquid compositions are packed into film pouches, each pouch containing about 20 to about 40 ml of liquid. The film used to make the pouches is commercially available film, MonoSol 8310® or Aicello GA or Aicello GS. The process for manufacturing the unit dose detergent compositions are known in the art, as shown in, e.g., U.S. Pat. Nos. 4,973,416 and 6,479,448.

Example 1: Liquid Composition with Approximately 16 wt % of Water[a]

| Material | % W/W | % Water from Material |
|---|---|---|
| C12-C15 Alcohol Ethoxylate | 20.0 | 0.03 |
| Hexylene Glycol | 10.9 | 0.0108 |
| DI Water | 5.11 | 5.11 |
| Glycerol | 7.5 | 0.01125 |
| Methylglycinediacetic Acid | 2.0 | 1.22 |
| Sodium Sulfite | 0.10 | 0 |
| Optical Brighter | 0.25 | 0 |
| Monethanolamine | 3.0 | 0.0045 |
| Alkylbenzene Sulfonic Acids | 10.0 | 0.0375 |
| 60 wt % Alkyl Ether Sulfate (AES) | 30.0 | 7.2 |
| Coconut Oil Fatty Acid | 5.0 | 0 |
| Dye | 0.01 | 0 |
| Polyethylene imine; ethoxylated | 2.5 | 0.5 |
| Enzymes | 2.9 | 1.416 |
| Fragrance | 0.75 | 0 |
| Total | 100.0 | 15.5 |

[a] The total water amount in each Example is calculated by summing up the water contained in each ingredient. For example, alkyl ether sulfate (AES) is added as a 60 wt % aqueous solution and contains about 24 wt % of water, so there is about 7.2 wt % of water in the 30 wt % alkyl ether sulfate (AES).

Example 2: Liquid Composition with Approximately 19 wt % of Water

| Material | % W/W | % Water from Material |
|---|---|---|
| C12-C15 Alcohol Ethoxylate | 20.0 | 0.03 |
| Hexylene Glycol | 36.0 | 0.0385 |
| Lauramine Oxide | 10.0 | 7.0 |
| Methyl Ester Ethoxylate | 10.0 | 0.05 |
| DI Water | 11.3 | 11.3 |
| Optical Brighter | 0.20 | 0 |
| Polyethylene imine; ethoxylated | 2.5 | 0.5 |
| Oleic Acid | 10.0 | 0 |
| Total | 100.0 | 18.9 |

Example 3: Liquid Composition with Approximately 20 wt % of Water

| Material | % W/W | % Water from Material |
|---|---|---|
| C12-C15 Alcohol Ethoxylate | 18.0 | 0.027 |
| Hexylene Glycol | 7.7 | 0.0077 |
| Methyl Ester Ethoxylate | 10.0 | 0.05 |
| DI Water | 12.85 | 12.85 |
| Optical Brighter | 0.20 | 0 |
| Monethanolamine | 5.0 | 0.0075 |

-continued

| Material | % W/W | % Water from Material |
|---|---|---|
| Alkylbenzene Sulfonic Acids | 20.0 | 0.075 |
| 70 wt % Sodium Laureth Sulfate (3-EO) | 15.0 | 4.5 |
| Polyethylene imine; ethoxylated | 2.5 | 0.5 |
| Coconut Oil Fatty Acid | 5.0 | 0 |
| Dye | 0.01 | 0 |
| Enzymes | 3.1 | 1.524 |
| Fragrance | 0.60 | 0 |
| Total | 100.0 | 19.5 |

Example 4: Liquid Composition with Approximately 25 wt % of Water

| Material | % W/W | % Water from Material |
|---|---|---|
| C12-C15 Alcohol Ethoxylate | 18.0 | 0.027 |
| Hexylene Glycol | 8.2 | 0.0082 |
| Methyl Ester Ethoxylate | 10.0 | 0.0500 |
| DI Water | 19.35 | 19.35 |
| Optical Brighter | 0.25 | 0 |
| Monethanolamine | 5.0 | 0.0075 |
| Alkylbenzene Sulfonic Acids | 20.0 | 0.075 |
| 70% Sodium Laureth Sulfate (3-EO) | 10.0 | 3.0 |
| Coconut Oil Fatty Acid | 3.0 | 0 |
| Polyethylene imine; ethoxylated | 2.5 | 0.5 |
| Dye | 0.01 | 0 |
| Enzymes | 3.1 | 1.524 |
| Fragrance | 0.60 | 0 |
| Total | 100.0 | 24.5 |

Example 5: Liquid Composition with Approximately 30 wt % of Water

| Material | % W/W | % Water from Material |
|---|---|---|
| C12-C15 Alcohol Ethoxylate | 18.0 | 0.027 |
| Hexylene Glycol | 9.4 | 0.0094 |
| Methyl Ester Ethoxylate | 10.0 | 0.05 |
| DI Water | 24.47 | 24.47 |
| Optical Brighter | 0.25 | 0 |
| Monethanolamine | 3.7 | 0.0056 |
| Alkylbenzene Sulfonic Acids | 15.0 | 0.0563 |
| 70 wt % Sodium Laureth Sulfate (3-EO) | 10.0 | 3.0 |
| Coconut Oil Fatty Acid | 3.0 | 0 |
| Polyethylene imine; ethoxylated | 2.5 | 0.5 |
| Dye | 0.01 | 0 |
| Enzymes | 3.1 | 1.524 |
| Fragrance | 0.60 | 0 |
| Total | 100.0 | 29.6 |

Example 6: Liquid Composition with Approximately 25 wt % of Water

| Material | % W/W | % Water from Material |
|---|---|---|
| C12-C15 Alcohol Ethoxylate | 20.0 | 0.03 |
| Hexylene Glycol | 15.1 | 0.0151 |
| DI Water | 14.17 | 14.17 |

-continued

| Material | % W/W | % Water from Material |
|---|---|---|
| Methylglycinediacetic Acid | 2.0 | 1.22 |
| Optical Brighter | 0.25 | 0 |
| Sodium Sulfite | 0.10 | 0 |
| Monethanolamine | 3.0 | 0.0045 |
| Alkylbenzene Sulfonic Acids | 10.0 | 0.0375 |
| 70 wt % Sodium Laureth Sulfate (3-EO) | 24.0 | 7.2 |
| Coconut Oil Fatty Acid Whole | 5.0 | 0 |
| Polyethylene imine; ethoxylated | 2.5 | 0.5 |
| Enzymes | 3.1 | 1.524 |
| Fragrance | 0.75 | 0 |
| Dye | 0.01 | 0 |
| Total | 100.0 | 24.7 |

Example 7: Liquid Composition with Approximately 18 wt % of Water

| Material | % W/W | % Water from Material |
|---|---|---|
| C12-C15 Alcohol Ethoxylate | 25.0 | 0.04 |
| Propylene Glycol | 13.6 | 0.0136 |
| Glycerol | 2.5 | 0.0037 |
| Monoethanolamine | 3.1 | 0.0310 |
| Alkylbenzene Sulfonic Acids | 4.5 | 0.0169 |
| Coconut Oil Fatty Acid Whole | 10.0 | 0 |
| Dye | 0.2 | 0 |
| 76 wt % Alkyl ether sulfate (AES) | 26.0 | 6.24 |
| DI Water | 8.5 | 8.51 |
| 15 wt % Sodium Sulfite | 2.0 | 1.73 |
| Polyethylene imine; ethoxylated | 2.0 | 0.40 |
| Bittering agent | 0.04 | 0 |
| Enzymes | 2.5 | 1.20 |
| Total | 100.0 | 18.2 |

Example 8: Liquid Composition with Approximately 20 wt % of Water

| Material | % W/W | % Water from Material |
|---|---|---|
| C12-C15 Alcohol Ethoxylate | 20.0 | 0.03 |
| Propylene Glycol | 15.8 | 0.0158 |
| Glycerol | 3.0 | 0.0045 |
| Monoethanolamine | 3.1 | 0.0310 |
| Alkylbenzene Sulfonic Acids | 5.0 | 0.0188 |
| Coconut Oil Fatty Acid | 10.0 | 0 |
| Dye | 0.2 | 0 |
| 70 wt % Alkyl ether sulfate (AES) | 26.0 | 6.24 |
| DI Water | 10.3 | 10.28 |
| 15 wt % Sodium Sulfite | 2.0 | 1.73 |
| Polyethylene imine; ethoxylated | 2.0 | 0.40 |
| Bittering agent | 0.04 | 0 |
| Enzymes | 2.5 | 1.20 |
| Total | 100.0 | 20.0 |

It is to be appreciated that the Detailed Description section, in addition to the Summary and Abstract sections, is intended to be used to interpret the claims. The Summary and Abstract sections may set forth one or more but not all exemplary embodiments of the present invention as contemplated by the inventor(s), and thus, are not intended to limit the present invention and the appended claims in any way.

The breadth and scope of the present invention should not be limited by any of the above-described exemplary embodiments, but should be defined only in accordance with the following claims and their equivalents.

What is claimed is:

1. A unit dose detergent composition, comprising: a water-soluble container formed from a water-soluble film material enclosing a liquid composition, wherein the liquid composition comprises:

at least one alkyl ether sulfate (AES), at least one humectant selected from the group consisting of heptylene glycol, octylene glycol, and mixtures therefor, and about 15 wt % to about 35 wt % of water, and wherein the liquid composition comprises about 10 wt % to about 40 wt % of the one or more humectants.

2. The unit dose detergent composition according to claim 1, wherein the liquid composition comprises about 5 wt % to about 25 wt % of the at least one alkyl ether sulfate (AES).

3. The unit dose detergent composition according to claim 1, wherein the at least one alkyl ether sulfate (AES) is sodium lauryl ether sulfate (SLES).

4. The unit dose detergent composition according to claim 1, wherein the water-soluble film material is selected from the group consisting of polyvinyl alcohol (PVA), film forming cellulosic polymer, poly acrylic acid, polyacrylamide, polyanhydride, polysaccharide, and a mixture thereof.

5. The unit dose detergent composition according to any of claim 1, wherein the water-soluble film material is polyvinyl alcohol (PVA).

6. The unit dose detergent composition according to claim 1, wherein the liquid composition comprises about 25 wt % to about 35 wt % of water.

7. The unit dose detergent composition according to claim 1, wherein the liquid composition comprises about 25 wt % of water.

8. The unit dose detergent composition according to claim 1, wherein the liquid composition comprises about 30 wt % of water.

9. A unit dose detergent composition, comprising: a water-soluble container formed from a water-soluble film material enclosing a liquid composition, wherein the liquid composition comprises:

about 15 wt % to about 30 wt % of at least one anionic surfactant and about 15 wt % to about 30 wt % of at least one nonionic surfactant, at least one humectant selected from the group consisting of butylene glycol, pentylene glycol, hexylene glycol, heptylene glycol, octylene glycol, 2-methyl-1,3-propanediol, xylitol, sorbitol, mannitol, erythritol, dulcitol, inositol, adonitol, and mixtures thereof, and about 25 wt % to about 35 wt % of water, and wherein the liquid composition comprises about 10 wt % to about 40 wt % of the one or more humectants, and wherein the at least one humectant comprises heptylene glycol, octylene glycol, or a combination thereof.

10. The unit dose detergent composition according to claim 1, wherein the liquid composition comprises about 30 wt % to about 35 wt % of water.

* * * * *